US006244460B1

(12) United States Patent
Winberg

(10) Patent No.: US 6,244,460 B1
(45) Date of Patent: Jun. 12, 2001

(54) PLASTIC PACKAGE FOR A STRAW APPLIED TO A DRINK CONTAINER

(76) Inventor: Ragnar Winberg, Silvåkragatan 87, 254 58 Helsingborg (SE)

( * ) Notice: Subject to any disclaimer, the term of this patent is extended or adjusted under 35 U.S.C. 154(b) by 0 days.

(21) Appl. No.: 09/423,987

(22) PCT Filed: Jun. 12, 1998

(86) PCT No.: PCT/SE98/01128

§ 371 Date: Nov. 16, 1999

§ 102(e) Date: Nov. 16, 1999

(87) PCT Pub. No.: WO98/57867

PCT Pub. Date: Dec. 23, 1998

(30) Foreign Application Priority Data

Jun. 16, 1997 (SE) ..... 9702280

(51) Int. Cl.[7] ..... B65D 83/00; B65D 73/00; B65D 77/28

(52) U.S. Cl. ..... 220/705; 206/229; 206/470; 220/710; 229/103.1

(58) Field of Search ..... 220/705, 708, 220/710, 906, 735, 709; 206/217, 813, 468–470, 461, 229; D9/337; 215/388, 389, 229; 229/103.1

(56) References Cited

U.S. PATENT DOCUMENTS

| | | | | |
|---|---|---|---|---|
| D. 310,326 | * | 9/1990 | Carlsen | D9/337 |
| D. 349,048 | * | 7/1994 | Hjalmarsson | D9/337 |
| 2,013,475 | * | 9/1935 | Orton | 206/217 X |
| 3,332,567 | * | 7/1967 | Pugh, Sr. | 220/710 X |
| 3,370,365 | * | 2/1968 | Vosbikian | 206/813 X |
| 3,581,885 | * | 6/1971 | Wald | 206/470 |
| 3,623,632 | * | 11/1971 | Chang | 215/388 X |
| 3,695,419 | * | 10/1972 | Packert et al. | 206/470 |
| 3,792,798 | * | 2/1974 | Chang | 220/708 |
| 4,005,776 | * | 2/1977 | Seeley | 206/420 X |
| 4,266,667 | * | 5/1981 | Ishigaki | 206/469 |

FOREIGN PATENT DOCUMENTS

| | | | | |
|---|---|---|---|---|
| 927035 | * | 5/1963 | (GB) | 206/470 |
| 932694 | * | 7/1963 | (GB) | 206/470 |

* cited by examiner

*Primary Examiner*—Bryon P. Gehman
(74) *Attorney, Agent, or Firm*—Fasth Law Offices; Rolf Fasth

(57) ABSTRACT

A package that has a flat base that is attached to a first capsule. The capsule has a straw placed therein that may be flattened and folded. A secondary capsule is attached to the base to cover the rest of the straw. The secondary capsule has a tab and overlaps the first capsule. The secondary capsule may be pulled away from the base to allow the straw to be removed therefrom and making further pulling impossible or very difficult and thus enabling the secondary capsule to remain attached to the package.

9 Claims, 6 Drawing Sheets

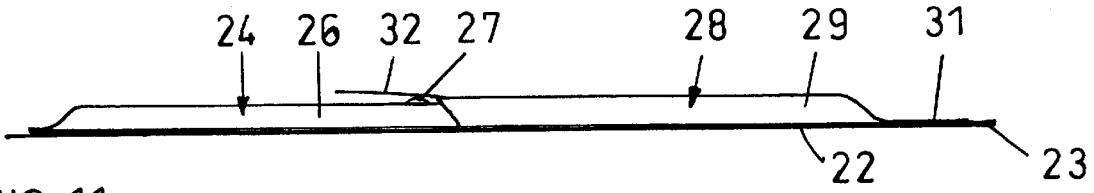
FIG. 11
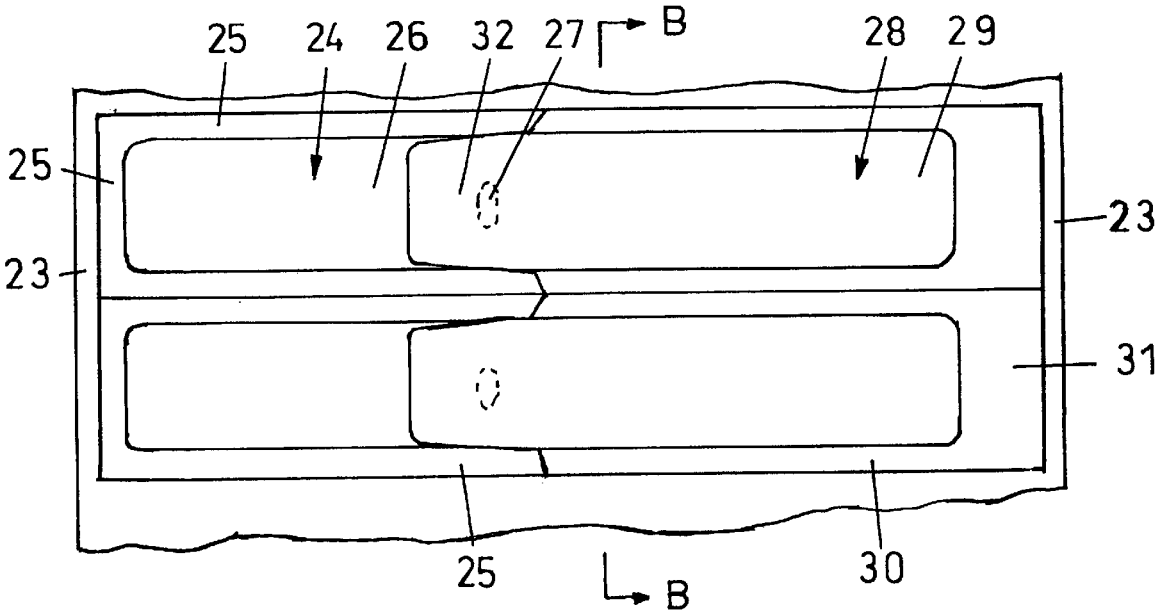
FIG. 12
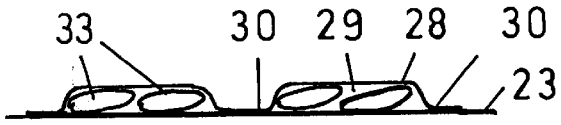

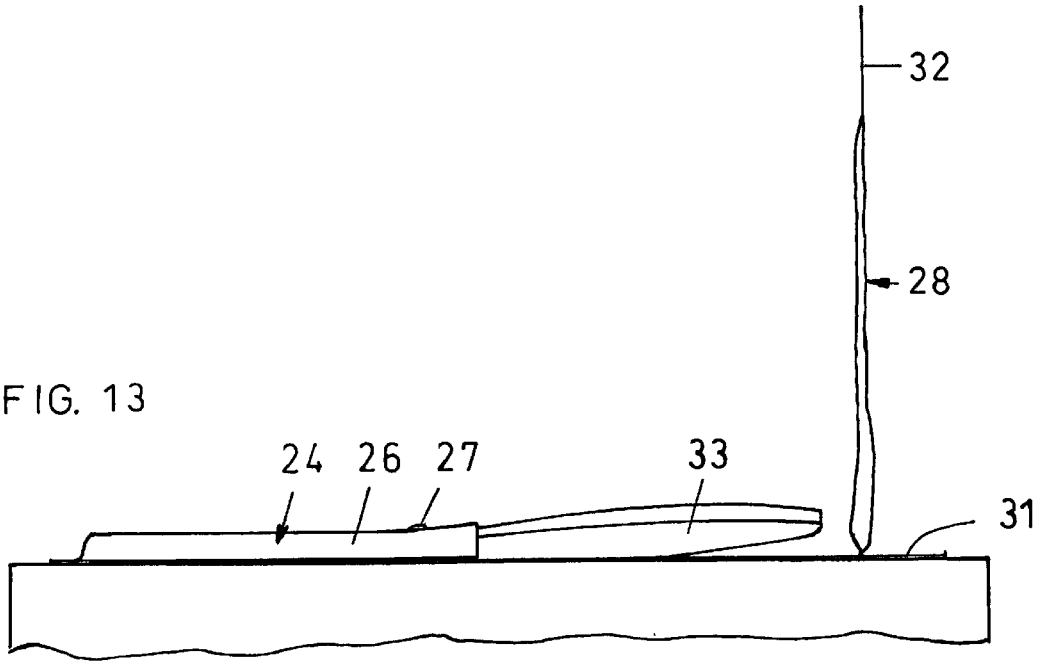
FIG. 13
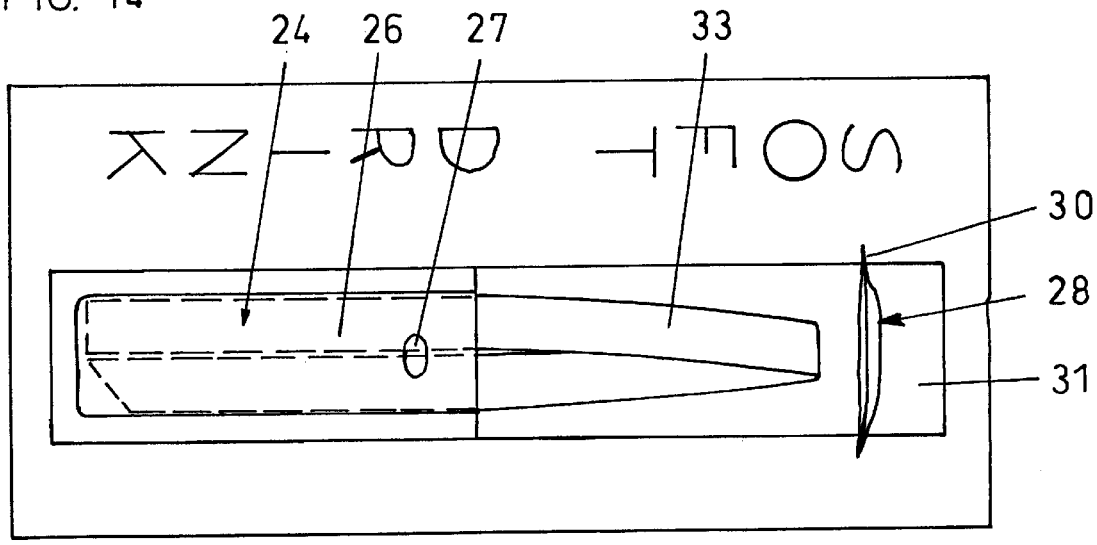
FIG. 14
FIG. 15

PLASTIC PACKAGE FOR A STRAW APPLIED TO A DRINK CONTAINER

BACKGROUND AND SUMMARY OF THE INVENTION

For many years beer and carbonated soft drinks have been sold in cylindrical aluminium cans. The can top comprises an opening, device, or pop-top. Previously, the pop-top was so constructed as to separate from the can top after opening, forming an unwanted piece of metal scrap. Later, this device was designed so as to remain attached to the top after the can was opened. This, since a separate piece of metal scrap was no longer produced, was a major advantage from an environmental point of view, considering the great number of cans of drink consumed out of doors, it was an extremely valuable improvement.

After a can of beer or soft drink has been opened, the drink is usually poured into a glass. However, soft drinks in particular are often drunk through a straw inserted into the opening made in the top of the can. Indeed, many cans of soft drink are sold for immediate consumption, and although it is possible to drink direct from the can, a glass or straw is often provided for the purpose. Clearly, however, this is difficult if the cans are to be sold to the public in special vending machines.

The purpose of this invention is to furnish a soft drinks can of the type that has now been available on the market for many years with an easily detachable straw shielded against the dirt by a protective device that cannot in itself become an unwanted piece of scrap. This is achieved in that a specially designed package containing a flattened, folded straw is secured to the bottom of the can, which, as viewed from the outside, affords a concavity suitable for the purpose. A variant of the invention may be applied to drink packages or cartons having a large flat surface. The characteristics of the invention are set forth in the claims.

BRIEF DESCRIPTION OF THE DRAWINGS

In the following paragraphs, the invention will be described in greater detail with reference to a set of drawings illustrating embodiments of the invention.

FIG. 11 illustrates a package for a soft drinks carton with a flat surface viewed from the side.

FIG. 12 illustrates two of the packages of FIG. 11 viewed from above.

FIG. 13 illustrates the packages of FIG. 12 viewed across the section B—B.

FIG. 14 illustrates an opened package viewed from the side attached to a soft drinks carton.

FIG. 15 illustrates the package of FIG. 14 viewed from above.

DETAILED DESCRIPTION

Figure 1:
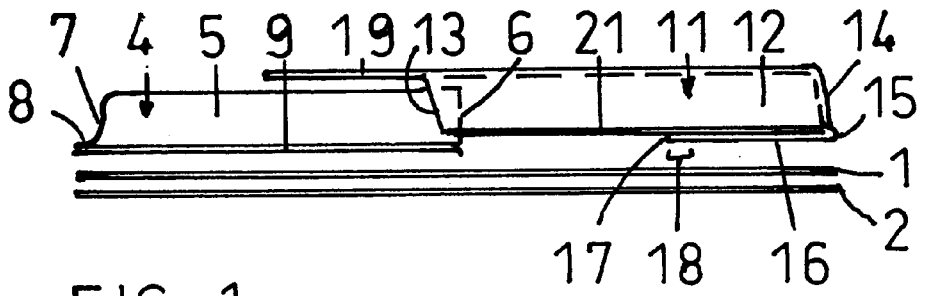
FIG. 1 illustrates the principles of a package intended for a soft drinks can viewed from the side.

FIG. 1, which illustrates the principles of the package, shows the various parts and layers of the package as if they were separated from each other, and for the sake of clarity, their thickness has been exaggerated. The package is intended to contain a flattened, folded straw and is intended for attachment to the bottom of a standard can, which, viewed from the outside, affords a concavity suitable for that purpose.

In FIGS. 1–10, the numeral 1 is used to designate a base of plastic foil, the underside of which is covered in its entirety by pressure-sensitive adhesive 2. The adhesive is covered with a removable protective sheet 3 treated with silicone. A principal capsule of plastic foil, here generally designated 4, is pressed into shape from flat foil so as to form a cavity 5. The inner end 6 of the principal capsule is open, whereas its outer end 7 is closed. The principal capsule is here welded to the base 1 across a narrow zone 8, the principal capsule being so formed as to have projecting flanges 9 along each side of the cavity 5. These flanges are securely welded to the base 1, their perimeter 10 corresponding to that of the base. This latter, however, is not strictly necessary.

A secondary capsule of plastic foil is here generally designated by the numeral 11. This capsule, too, has been pressed into shape from flat foil so as to form a cavity 12. The inner end 13 of the secondary capsule is open, whereas its outer end 14 is closed. The plastic foil has here been folded at its outer edge 15 so as to furnish the secondary capsule with a floor 16, the free edge 17 of which, before the secondary capsule was folded at its outer edge 15, was welded to the base 1 across a narrow zone 18. The secondary capsule overlaps the principal capsule and, above the latter, comprises a tab 19 by which the secondary capsule can be pulled away from the base 1. The underside of the tab is dotted with a small patch of pressure-sensitive adhesive 20. The secondary capsule, along each side of the cavity 12, is so formed as to have projecting flanges 21 lying against the base 1. The underside of these flanges is so weakly welded to the base 1 that it breaks or gives way when the package is opened. The perimeter of the flanges corresponds to that of the base, although this is not strictly necessary. Welding may be carried out in two narrow zones, one on each side of the cavity 12, or else the flap surfaces may be welded in their entirety. The flaps of the folded-in floor 16 must not be welded to the base 1; only the free edge zone 18 may be so welded.

Figure 2:
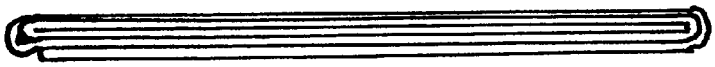
FIG. 2 illustrates a folded straw viewed from the side.

FIG. 2 shows a straw having an outer diameter of 5 millimeters and a material thickness of 0.13 millimeters, which is a size commonly encountered in this context. The straw has been flattened and folded into a bundle having a width of 8 millimeters and a length of 39 millimeters. The height of the bundle, stowed in the protective package, if the latter is flat, might be 3 millimeters, although capsules 4 and 11 may be so designed as to enable the bundle to be highest in tile middle and lower at either end.

Figure 3:
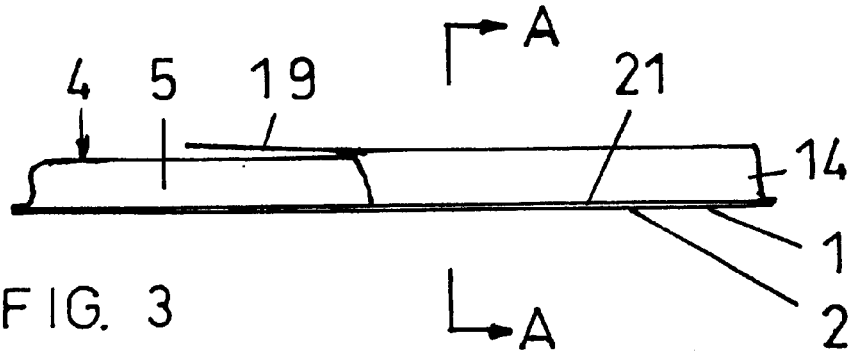
FIG. 3 illustrates a package for a soft drinks can viewed from the side.

FIG. 3 illustrates a package containing a straw.

Figure 4:
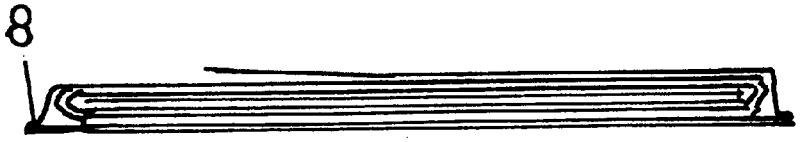
FIG. 4 illustrates a package containing a straw intended for a soft drinks can viewed in section from the side.

FIG. 4 illustrates the package of FIG. 3 seen in section from the side.

Figure 5:
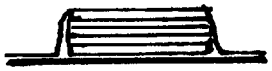
FIG. 5 illustrates the package of FIG. 3 viewed across the section A—A.

FIG. 5 illustrates the package of FIG. 3 seen across the section A—A.

Figure 6:
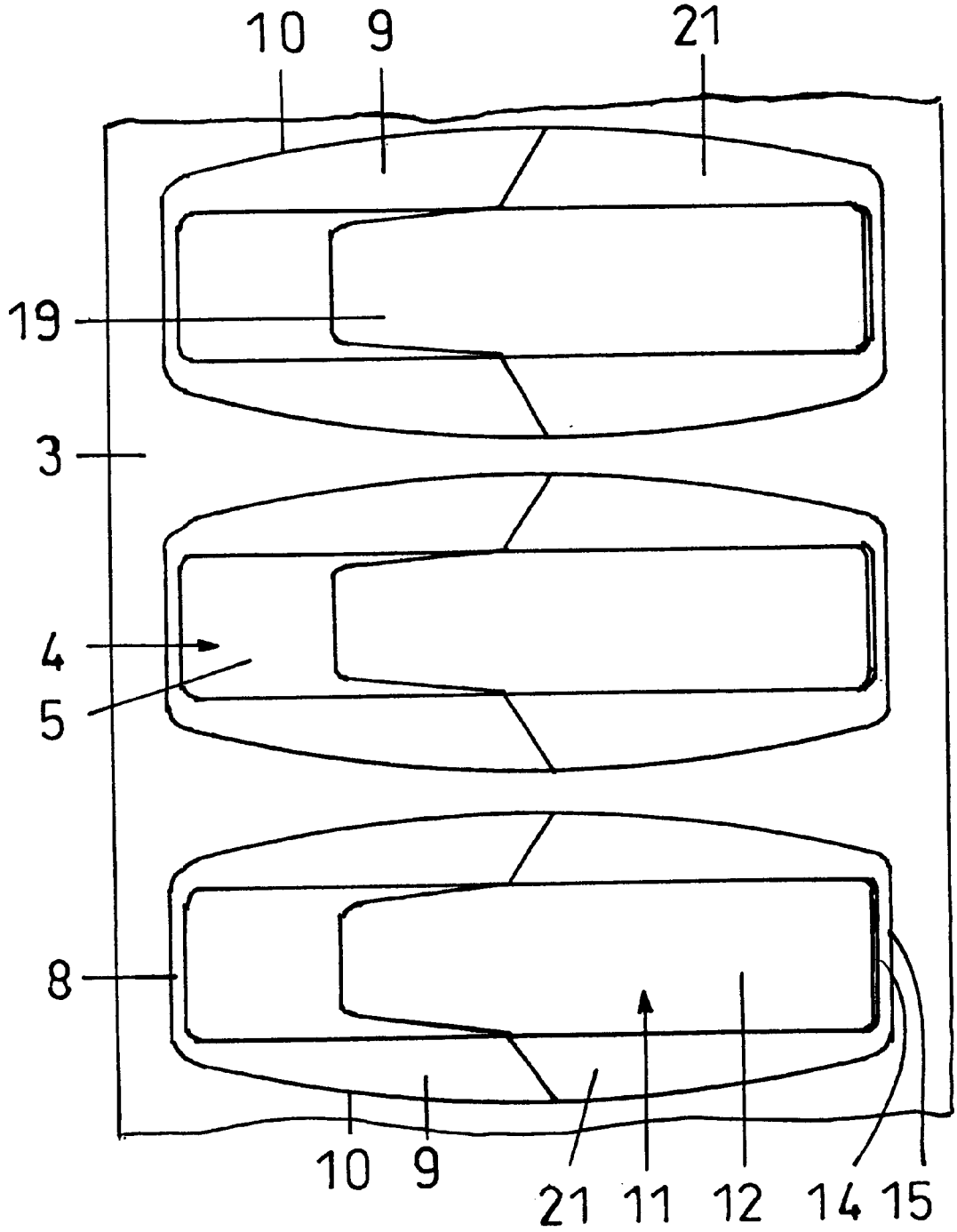
FIG. 6 illustrates three packages attached to a single backing sheet.

FIG. 6 illustrates three packages attached to a single backing sheet 3. Here, superfluous material between and outside the packages has been removed.

Figure 7:
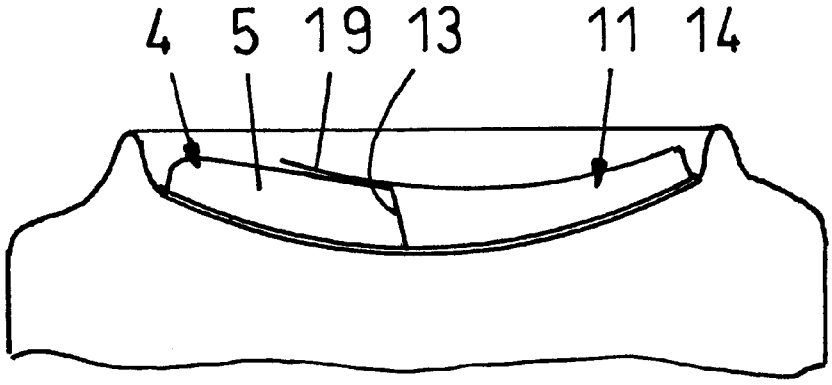
FIG. 7 illustrates a package, viewed from the side, attached to the bottom of a can, the can itself being viewed in section.

FIG. 7 illustrates a package, viewed from the side, attached to the bottom of a can, the can itself being viewed in section. Owing to its flexibility, as it is placed in position the plastic foil base 1 shapes itself so as to lie snugly against tile concave surface of the can bottom.

Figure 8:
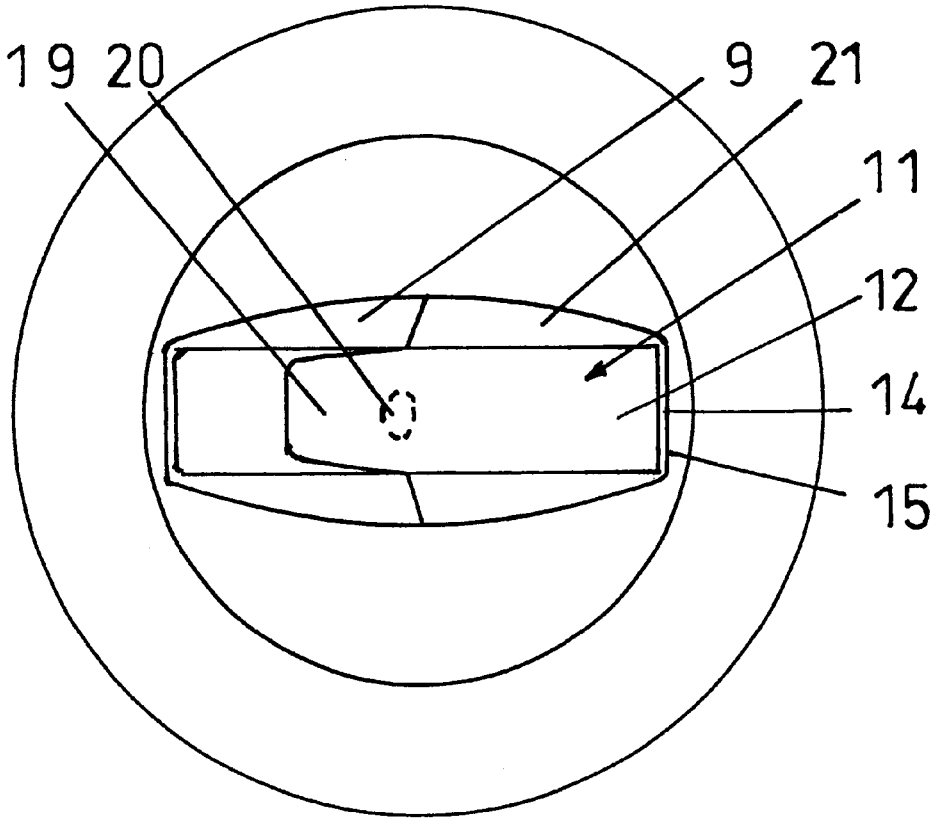
FIG. 8 illustrates the package of FIG. 7 viewed from above.

FIG. 8 illustrates the package of FIG. 7 viewed from above. The base 1, as are the lateral flanges 9 and 21, is wider towards tile centre of the package. On attaching the package to the can, the lateral flanges may be firmly pressed against the can itself. Less pressure may be applied to the zone above the folded straw.

Figure 9:
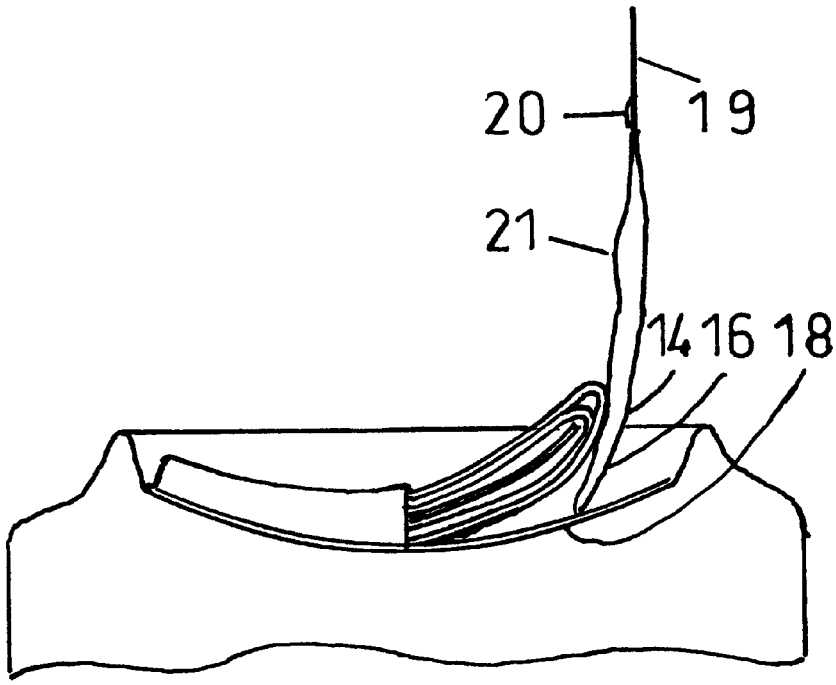
FIG. 9 illustrates the package of FIG. 7 opened.
Figure 10:
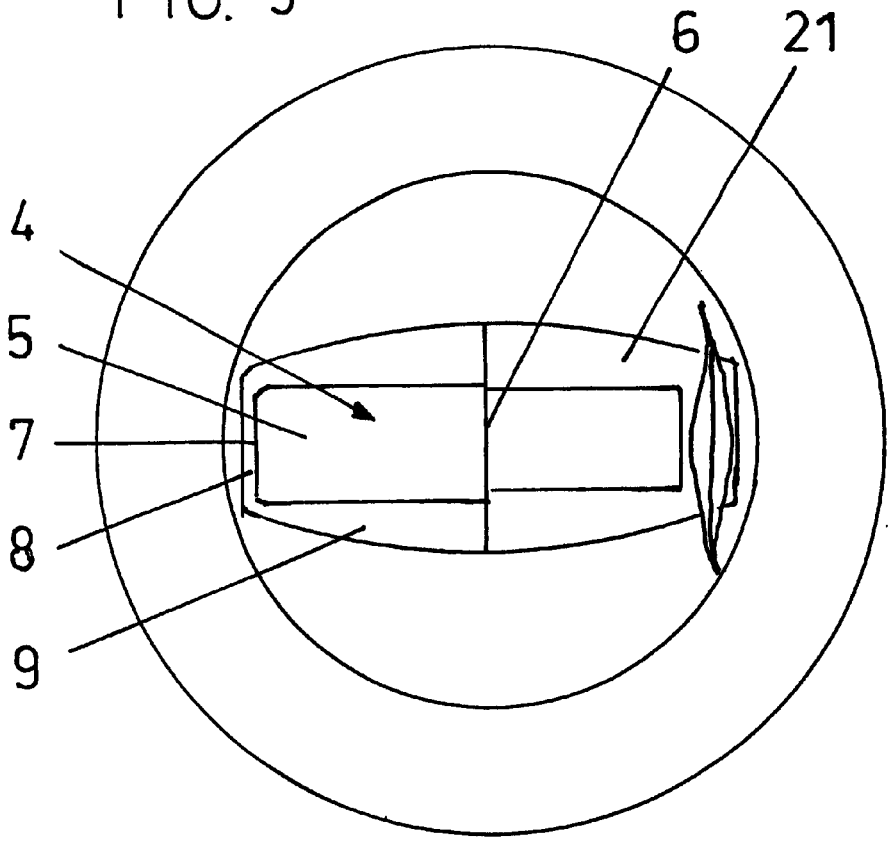
FIG. 10 illustrates the package of FIG. 8 opened.

FIG. 9 illustrates the package of FIG. 7 opened. The package is opened by pulling the tab 19. On opening, the tab first breaks away from the primary capsule 4 as the weak attachment ensured by the pressure-sensitive adhesive 20 is ruptured. As pulling continues, the welding between the flanges 21 of the secondary capsule and the base 1 breaks as the flanges and base are split apart. When the secondary capsule has been pulled up as far as illustrated in the figure, it can be pulled no further since the floor 16 is securely welded to tile base at 18. As the base 1 is glued to the can over a considerable area outside the welded zone 18, the base cannot be split apart from the can, regardless of whether the tab is pulled straight up, from the front or from behind. Now that about half of the folded straw has been freed, it is easy to take it out of the principal capsule 4. The opened secondary capsule 11 may then be folded back into position and attached to the primary capsule by means of the pressure-sensitive adhesive 20 on the underside of the tab. Once removed, tile inherent tension of the straw causes it to unfold and spring more or less into shape. The straw is then lightly rolled between index finger and thumb to remove the folds and restore the straw to its original roundness.

In FIGS. 11–15, a base provided with pressure-sensitive adhesive is designated by the numeral 22. This base is covered with a protective sheet 23 treated with silicone. To the base 22 is attached a principal capsule 24 firmly welded to the base 22 at the zones 25 outside its internal cavity 26. On top of the capsule there is a small spot of pressure-sensitive adhesive 27. A secondary capsule 28 has projecting flanges 30 on each side of its internal cavity 29 and a large surface 31 outside its closed end. The secondary capsule has a tab 32 and overlaps the primary capsule. The flanges 30 are weakly welded to the base 22, whereas zone 31 is strongly welded to the base. The zones 26 and 29 house a straw 33 that has been flattened and folded. The straw is pointed at one end.

FIG. 11 illustrates a package viewed from the side.

FIG. 12 illustrates two packages attached to a backing sheet.

FIG. 13 illustrates the packages of FIG. 12 viewed across the section B—B.

FIG. 14 illustrates an opened package containing a folded, flattened straw, the package being attached to a soft drink carton viewed from the side.

FIG. 15 illustrates the package of FIG. 14 viewed from above.

The package is opened by pulling the tab 32 such that the welding between the secondary capsule and the base 22 gives way. Once this has happened, further pulling is impossible, or at least very difficult. As already mentioned, the secondary capsule is firmly welded to the base at zone 31, and the separation of the base 22 from the drink carton is rendered more difficult in that a large zone 31 of the secondary capsule is outside the internal cavity 29 and the base 22 is firmly glued to the drink carton.

Once the secondary capsule has been opened as illustrated in the figure, it is simple to grasp the folded straw and remove it from the primary capsule. The straw is restored to its original roundness by grasping it between the thumb and index finger and the fold disappears. Instead of welding the capsules to the base, they may be glued. An arrangement may also be envisaged whereby the secondary capsule is provided with two lines of perforations that will break when the package is opened, rather than having the package break at the places where the flanges 30 of the capsule are welded to the base 22.

The straw is here illustrated flattened, and tile fold may of course be of some other type, e.g. it may be of a smaller diameter and be round, and it may be provided with the familiar bellows-like fold. After the straw has been removed the tab 32 may be re-attached to the principal capsule by means of the pressure-sensitive adhesive 27.

The capsules of which the package is comprised, like the base, may instead of plastic foil be made of plastic-coated paper. If tile capsules are made of foil, the foil may be completely transparent, lightly coloured or opaque.

If, in particular, the secondary capsule is of very thin plastic, it may be useful to stiffen the tab by folding it double or by some other means.

The underside of the package need not be attached with pressure-sensitive adhesive. Instead, hot-melt adhesive, for example, may be applied when the package is attached to the carton, either on the straw package or directly on the drink carton.

The package intended for soft drink cans may be applied in connection with the manufacture of the cans; or, it may be applied in the filling premises, either before or after the cans have been filled. If the package is to be applied after filling, a suitable approach would be to turn the cans bottom up using known technology, to attach the straw packets, and thereafter to turn the cans the right way up. All this may be achieved while the cans are moved at speed through the filling room.

In the case of cans, it is important to ensure that the straw is so placed as not to hinder the passage of tile can through the filling room or the packing of cans into six-packs. The present package does not represent such a hindrance. It is also important that it be possible to leave the package untouched if the straw is not to be used. It is thus not possible to position the package on the can top.

There are several methods of manufacturing a straw package suitable for cans. A suitable approach might first be to weld a principal capsule (4) stamped out of foil to a plastic web (1) to which is applied pressure-sensitive adhesive (2) and a backing sheet (3), then to introduce the straw, flattened and folded into a bundle, its free end first. Alternatively, the straw may be folded in a zigzag shape. The floor (16) of the secondary capsule, at its free edge (17), is then securely welded to tile plastic web (1), the secondary capsule is folded back (15) and its flanges (21) are weakly welded to the plastic web (1). At this stage, any superfluous material may be removed from the backing sheet (3). The packages held on the backing web (3) may be wound up into a roll of large diameter from which the packages can be fed out and rapidly attached to the drink packages.

To succeed in commercial terms, it is essential that the packages can be applied to existing can types, which are manufactured in enormous quantities.

While the present invention has been described accordance with preferred compositions and embodiments, it is to be understood that certain substitutions and alterations may be made thereto without departing from the spirit and scope of the following claims.

What is claimed is:

1. An elongate beverage container package housing a straw comprising:

a base having an entire bottom side bearing against a beverage container and an opposite side facing the straw;

a first capsule disposed at one end of the package, the first capsule having a first internal cavity defined therein, a closed outer end of the first capsule being attached to the base, the first capsule having two long sides being attached to the top side of the base in first zones that are disposed outside the first internal cavity;

a second capsule, made of a thin flexible sheet, disposed at an end of the package that is opposite the end of the first capsule, the second capsule having a second internal cavity defined therein, the second capsule having an open inner end and a closed outer end, the open inner end being separable from the base and the closed outer end of the second capsule being rotatable attached to the base, the second capsule having two long sides being attached to the base in second zones that are disposed outside the second internal cavity, the second capsule overlapping the first capsule; and the second capsule having a tab extending over the first capsule, the second capsule being movable between a closed position and an opened position, the open inner end of the second capsule being pulled away from the base and the closed outer end being rotatable about the base when the second capsule is in the open position to expose the straw, the second capsule remaining attached to the base of the package, the straw remaining inside the first capsule when the second capsule is in the open position.

2. The elongate package according to claim 1 wherein the base is provided with a pressure-sensitive adhesive by means of which the package is attached to the container.

3. The elongate package according to claim 2 wherein the package is attached to a backing web by means of the pressure-sensitive adhesive.

4. The elongate package according to claim 1 wherein the second capsule is separable from the base along the zones along which the second capsule is attached to the base.

5. The elongate package according to claim 1 wherein the second capsule has a folded section including a free end that is attached to the base.

6. The elongate package according to claim 1 wherein the base is sufficiently flexible to adapt to a concave bottom of a can.

7. The elongate package according to claim 1 wherein a pressure-sensitive adhesive is applied to a section where the first and second capsules overlap so that a free end of the second capsule is attachable to the first capsule when the second capsule is in an open position.

8. The elongate package according to claim 1 wherein the straw is flattened and folded to form a small bundle, the straw is parallel to the base.

9. The elongate package according to claim 1 wherein the package is attachable to an outside cavity of a bottom of a can.

* * * * *